United States Patent [19]

Lindström et al.

[11] Patent Number: 4,989,512

[45] Date of Patent: Feb. 5, 1991

[54] SQUEEGEE ARRANGEMENT

[75] Inventors: Astor Lindström, Rönninge; Christer Källroos, Vagnhärad, both of Sweden

[73] Assignee: Svecia Silkscreen Maskiner AB, Norsborg, Sweden

[21] Appl. No.: 372,471

[22] Filed: Jun. 28, 1989

[30] Foreign Application Priority Data

Jun. 28, 1988 [SE] Sweden ..... 8802430

[51] Int. Cl.[5] ..... B41F 15/44

[52] U.S. Cl. ..... 101/123; 101/169

[58] Field of Search ..... 101/123, 127, 169; 15/256.5, 256.51, 256.53

[56] References Cited

U.S. PATENT DOCUMENTS

| | | | |
|---|---|---|---|
| 3,071,069 | 1/1963 | Sherman | 101/123 |
| 3,930,455 | 1/1976 | Jaffa | 101/123 |
| 4,102,266 | 7/1978 | Porth | 101/124 |
| 4,715,278 | 12/1987 | Ericsson | 101/114 |
| 4,779,529 | 10/1988 | Ericsson | 101/123 |
| 4,781,114 | 11/1988 | Ericsson | 101/123 |
| 4,841,844 | 6/1989 | Bubley | 101/123 |
| 4,940,354 | 7/1990 | Holderegger et al. | 15/256.51 |

FOREIGN PATENT DOCUMENTS

| | | | |
|---|---|---|---|
| 2739987 | 3/1978 | Fed. Rep. of Germany . | |
| 376083 | 5/1964 | Switzerland | 101/123 |

*Primary Examiner*—Edgar S. Burr
*Assistant Examiner*—Ren Yan
*Attorney, Agent, or Firm*—Burns, Doane, Swecker & Mathis

[57] ABSTRACT

The invention relates to a squeegee arrangement which is particularly intended for use in a silk-screen printer and which comprises a squeegee (2) and a squeegee holder (4, 5). The squeegee (4, 5) is provided with a plurality of support positions (11, 12; 11*a*, 12*a*; 11*b*, 13*b*), each being intended to support a squeegee profile (2) of predetermined height dimension.

18 Claims, 1 Drawing Sheet

SQUEEGEE ARRANGEMENT

TECHNICAL FIELD

The present invention relates to a squeegee arrangement and particularly, but not exclusively, to a squeegee arrangement which can be used advantageously in fully or semi-automatic silk-screen printers.

The squeegee arrangement to which this invention relates is constructed particularly for use in silk-screen printers of the kind described and illustrated in European Pat. application No. EP-A1-0 252 197.

BACKGROUND PRIOR ART

Squeegee arrangements adapted for use in silk-screen printers are known in various different forms.

Of particular interest to the present invention is the manner in which the actual squeegee blade of the known squeegee arrangements is mounted onto a squeegee holder.

Examples of such mountings or attachments are described and illustrated in prior publications CH-A- 297 376 and FR-A- 1 178 062.

CH-A-376083 teaches a method in which the upper edge of the rubber squeegee blade is embraced by a U-shaped structure having outwardly directed V-shaped supports intended co-action with one of several available grooves or channels, such as to enable the extent to which the squeegee projects beyond the holder to be selected in dependence of the groove used.

A separate device urges two holder parts towards one another, such as to grip the squeegee rubber in the holder parts.

SUMMARY OF THE INVENTION

Technical Problems

When considering the known prior art as described in the aforesaid prior publications, it will be seen that a primary technical problem is one of providing a squeegee arrangement which will enable a used squeegee blade, even after being ground, to be attached to the squeegee holder in a manner which will impart to the blade the same rigidity or stiffness, or at least essentially the same rigidity or stiffness, as that possessed by the blade prior to being ground, i.e. a blade which despite being ground down is still able to extend equally as far beyond the squeegee holder as a new blade.

Another technical problem is one of providing simple structural expedients in relation to a squeegee holder which will enable the squeegee blade to be mounted firmly in the lower edge part of the squeegee holder with the aid of a shoulder or like abutment, such as to obtain at said edge part a clearly defined clamping action, irrespective of the height dimension of the squeegee blade, and therewith create conditions which are effective in imparting the same, or essentially the same degree of stiffness to the blade, by allowing the edge margin of the blade extending from the holder to be constant or, in all events, to lie within pre-determined narrow limit values.

Another technical problem is one of providing in respect of a squeegee arrangement, and in particular the squeegee holder of said arrangement, a structural design which will impart to the squeegee blade a degree of stiffness which is sufficient to result in satisfactory squeegee-pressure, despite the fact that the squeegee holder may comprise two single, mutually co-acting parts, where one part is robustly dimensioned and adapted to be held firmly to the machine and the squeegee holder, whereas the other is a weaker part with the clamping force concentrated to the lower part of the squeegee rubber.

A further technical problem in this regard is one of providing a flexurely rigid squeegee arrangement, and then in particular a flexurely rigid squeegee holder, without needing to take measures which would increase unnecessarily the weight of said arrangement and said holder over and above those weight values conventional for prior art squeegee arrangements.

Another problem is one of realizing that selectable support positions for the upper edge part of the squeegee blade can be accommodated in a recess defined by said two parts, and therewith afford the advantage of enabling a squeegee blade, essentially independent of its height dimension, to be held firmly in one and the same squeegee holder. It is understood herewith that the squeegee blade will exhibit a degree of stiffness or rigidity which is essentially independent of the height dimension of the blade and solely dependent on the size of that part of the blade which extends beyond the squeegee holder.

A qualified technical realization is that of understanding that this can only be possible when the clamping force exerted by the two parts forming the squeegee holder is allowed to concentrate solely on the lower part of the squeegee blade.

Another technical problem is one of realizing that the squeegee blade can be mounted with sufficient firmness in special applications in which large forces act on the squeegee blade, when said blade is able to support against a rigid, internal support in the squeegee arrangement or in the parts forming the squeegee holder.

It will also be seen that a technical problem is one of realizing that a sufficient and satisfactory degree of rigidity is obtained, when the squeegee-blade clamping force is able to concentrate solely on the lower end parts of the squeegee holder components.

It will also be seen that a further technical problem is one of realizing that clamping of the squeegee blade at a location adjacent the lowermost part of the squeegee holder, which then guarantees suitable rigidity of one edge of the blade, and supporting of the opposite edge of the blade against a support which can be adjusted to one of a multiple of clearly defined positions, will actually be sufficient even when the squeegee moves in a direction and is positioned at an angle which engenders high pressure stresses on the squeegee blade.

Another technical problem is one of realizing that in the case of a squeegee holder construction comprising two flexurely rigid parts which clamp the blade, it is necessary to provide a plurality of clamping devices which act within the central region of a first profile, namely that which exhibits less rigidity.

A further technical problem is one of realizing that by providing a simple and suitably configured support, one and the same support can be used for one of a number of available support positions by means of which the position of the support can be adapted to the height dimension of the squeegee blade used at that time.

A more qualified technical problem is one of realizing that a support, in the form of a flat bar, can be complimented with a projection which will enable the number of support positions or support locations to be increased to a number in excess of that considered possible with the use of the number of grooves provided and a standard flat bar. This number of support positions can at present only be increased by turning one side or the other of the bar towards the upper surface or edge of the squeegee blade.

Another technical problem resides in providing a construction which will enable the squeegee blade to be used to a greater extent, i.e. so that the blade can be re-used several times after being ground, while still affording the same, or essentially the same degree of stiffness, as a result of ensuring that the extent to which the blade extends beyond the squeegee holder can be held constant, or at least substantially constant, irrespective of the prevailing height dimension of the squeegee blade.

Finally, it will be seen that a technical problem resides in the provision of a profile for respective parts of the squeegee holder which renders the one profile less rigid and which is constructed to assist significantly in the clamping of the blade but which when clamping said blade will also contribute to the total stiffness or rigidity of the squeegee holder to an extent greater than the other part of said holder, and which construction, with the squeegee blade clamped by means of the clamping arrangement, forms a sufficiently flexurely rigid structure for all kinds of printing processes carried out in a silk-screen printer.

SOLUTION

The present invention relates to a squeegee arrangement which is intended particularly, but not exclusively, for use in silk-screen printers.

The squeegee arrangement is based on a construction comprising a squeegee, an elongated squeegee, or a squeegee blade and a squeegee holder intended for firmly holding the actual squeegee.

In the case of such squeegee arrangements, the invention is base on the assumption that the squeegee holder is provided with a number of support positions intended to support a squeege profile having a pre-determined height dimension. Thus, a first support position is used within a first height dimension range, a second support position is used within a second height dimensioned range, and so on.

In accordance with one particular advantageous embodiment of the invention the squeegee holder comprises two elongated parts which are pivotally connected to one another, and that these parts are so mutually configured as to form a recess capable of accommodating the squeegee blade, and that grooves are provided along the defining walls of the recess for holding one and the same support means.

According to suitable embodiments, there extends between the two aforesaid two parts a clamping arrangement arranged within a central part of one of said parts. This clamping device may comprise a screw or bolt which co-acts with a screw threaded part of the one holder part, said screw threaded part being located closer to the rotational point of the one holder part than its clamping co-action with the squeegee blade.

The number of support positions may advantageously be two, three or four, when one and the same support is moveable and in the form of a flat bar, whose opposing edge portions are arranged for co-action with a respective recess in each of said holder parts.

For the purpose of increasing the number of support points or support locations, the flat rod may be provided with a projection between said recesses, and when the flat bar is turned, the recess may face towards the squeegee blade and there form a support surface located between the recesses.

It is proposed in accordance with the invention that each of the two holder parts comprises an extruded lightmetal profile.

ADVANTAGES

Those advantages primarily afforded by a squeegee arrangement constructed in accordance with the invention reside in more effective use of the squeegee blade material, since the invention enables the blade to be clamped adjacent the free end of the blade and provides within the squeegee holder a squeegee blade support which can be moved to a position which corresponds to the prevailing height dimension of the squeegee blade. Larger height dimensions require a higher support position, whereas smaller height dimensions require a lower support position, since the holding forces are concentrated to the lower part of the squeegee.

BRIEF DESCRIPTION OF THE DRAWING

An embodiment of an inventive squeegee arrangement at present preferred and exhibiting significant features of the invention will now be described in more detail with reference to the accompanying drawing, in which.

DESCRIPTION OF PREFERRED EMBODIMENTS

Figure 1:
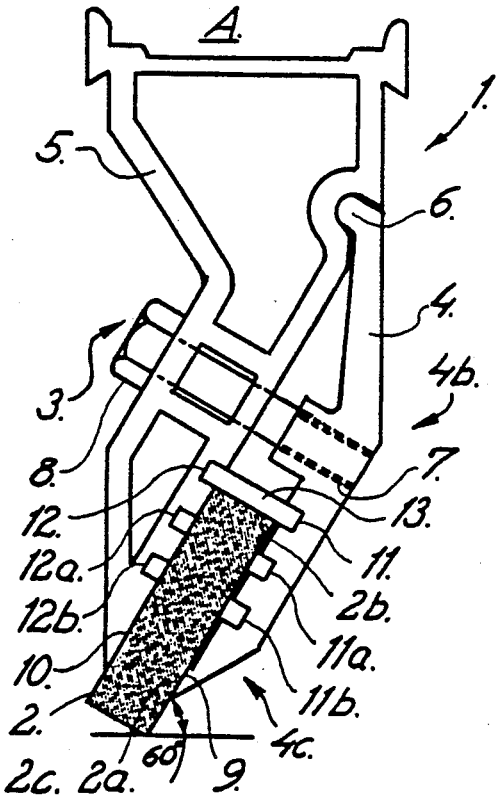
FIG. 1 is a sectional side view of an inventive squeegee arrangement.

FIG. 1 is a sectional side view of an inventive squeegee arrangement, generally referenced 1.

Although the side view of FIG. 1 does not illustrate the longitudinal extension of the squeegee arrangement 1, it will be understood that the length of the arrangement is contingent on the dimensions of the stencil frame used. It can be assumed, however, that the illustrated squeegee arrangement has a length of 3 meters or more.

The squeegee arrangement 1 co-acts with and is stiffened by a support "A" (not shown in the figure) located above the arrangement 1.

The squeegee arrangement 1 includes a squeegee or a squeegee blade 2 which is firmly clamped in a squeegee holder 3, which comprises two elongated holder parts 4 and 5.

The one holder part 4 constitutes a clamping part and the other holder part 5 is fixed and acts as an anvil means or counter-force reaction surface, and both of said holder parts are produced from extruded, lightmetal profiles.

The holder part 4 is a homogenous structure, whereas the holder part 5 is a hollow structure. FIG. 1 illustrates the cross-sectional configuration of respective holder parts.

The holder part 4 is intended to co-act with the holder part 5 in a manner to enable a squeegee or a squeegee blade 2 to be clamped firmly between said parts, and the holder part 4 therefore pivotally co-acts with the holder part 5.

Figure 2:
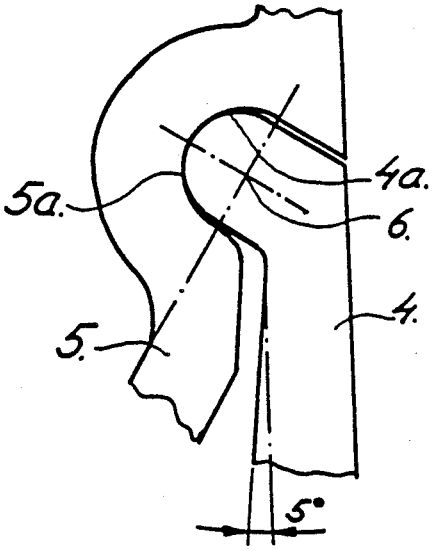
FIG. 2 is a slightly enlarged view of the pivotal attachment between the two parts forming a squeegee holder.

As will best be seen from FIG. 2, the holder part 4 includes an upper, semi-cylindrical slide surface 4*a* which is located in a semi-cylindrical groove or channel 5a in the other holder part 5, therewith to define a rotational axis 6 for mutual pivoting of the two holder parts.

Provided in the centre region 4b of the holder part 4, preferably displaced slightly in an upward direction, is a plurality of screw threaded holes 7 which are intended to receive the screw threaded portion of a bolt 8 included in respective clamping arrangements.

The lowermost part 4c of the one holder part 4 has provided thereon a shoulder 9 which is intended for clamping co-action with the lower part 2a of the squeegee blade. The squeegee blade 2 is thus clamped solely in the region of the shoulder 9, against an anvil surface on the other holder part 5. This anvil surface is referenced 10 in FIG. 1.

The one holder part 4 is also provided with grooves 11, 11a and 11b which face towards the squeegee blade 2, whereas the other holder part 5 is provided with grooves 12, 12a and 12b which also face towards the squeegee blade 2 and which are located diametrically to one another and therewith define a plurality of support positions, where a separate support can be caused to coact with any selected support position, depending entirely on the height dimension of the squeegee blade used.

As will be seen from FIG. 1, the grooves 11 and 12 coact with a support device having the form of a flat bar 13, the upper edge surface 2b of the squeegee blade supporting against the under surface of the flat bar. The squeegee blade is thus not clamped at this instance.

When the squeegee blade used has the height dimension illustrated in FIG. 1, the support device 13 can be mounted in grooves 11 and 12, with the upper edge surface 2b of the squeegee blade supporting against said support device. When the squeegee blade used has a smaller height dimension, the upper surface 2b of the squeegee blade can be supported against a similar support device located in grooves 11a and 12a (or 11b, 12b). The illustrated embodiment enables one and the same flat bar 13 to be mounted in the grooves 11a and 12a (or 11b and 12b) when so required, which means that only one single flat bar 13 is needed.

The question of whether to choose the one support position or the other will depend on the extent to which the squeegee blade 2 shall extend beyond the shoulder 9 and the prevailing height dimension of the squeegee blade. It is a general desire to keep this distance within narrow limits, since the lower edge part 2c of the squeegee blade is required to have the same degree of rigidity or stiffness subsequent to being ground.

Figure 3:
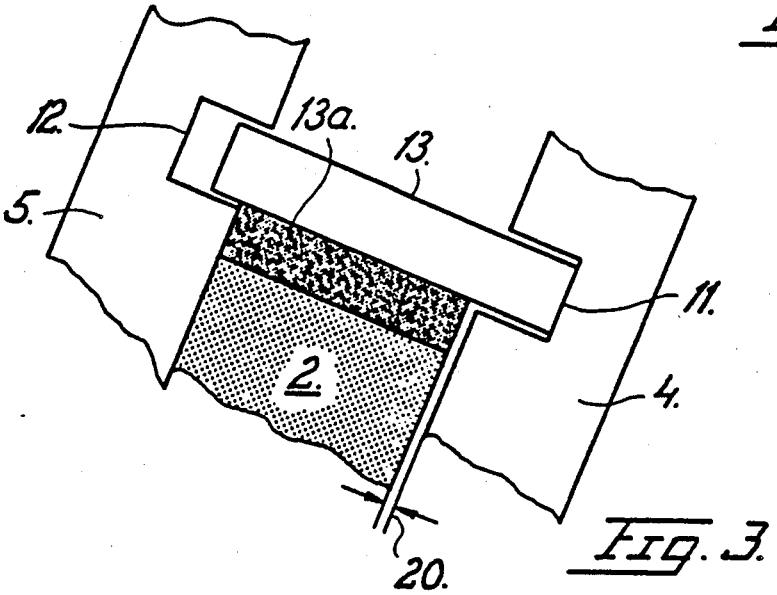
FIG. 3 is a slightly enlarged view of an alternative to the support means illustrated in FIG. 1.

By providing the flat bar 13 with a projection 13a whose height, or depth, can be adapted to half the distance between the grooves 11 and 11a, in the manner illustrated in FIG. 3, it is possible to increase the number of available support surfaces and support locations, without increasing the number of grooves 11, 11a and 11b.

It will also be seen from FIG. 3 that owing to the presence of the shoulder 9, that part of the squeegee blade 2 located above the shoulder 9 will be spaced at a distance 20 from the one holder part 4.

With regard to the dimensioning of the above-described squeegee arrangement, it can be mentioned that the distance between the grooves 11 and 11a can be adjusted to about 5 mm when the grooves have a width of about 3 mm. The shoulder 9 is able to act within a range of 3 to 8 mm, preferably about 4 mm, and can project out by about 1 mm.

The squeegee blade can have a thickness of about 10 mm, and the blade will suitably extend beyond the holder 3 through a distance of from 4 to 8 mm, preferably about 6 mm.

When grinding the squeegee blade, the depth to which the blade is ground can be conveniently selected so as to enable the next following support position to be used, such that the squeegee blade will extend beyond the lower part of the squeegee holder 3 to the same extent as the blade prior to being ground, therewith guaranteeing the same degree of elasticity.

It will be understood that the invention is not restricted to the described and illustrated embodiment and that modifications can be made within the scope of the inventive concept as defined in the following claims.

We claim:

1. A squeegee arrangement for use in silk-screen printers and including a squeegee and a squeegee holder for holding the squeegee, the squeegee holder being provided with a plurality of support positions, each of said support positions being provided for supporting a squeegee of predetermined height dimension, wherein the squeegee holder comprises two parts pivotally connected together, one of said two parts being directly pivotally connected only to the other of said two parts, said other part being the only one of said parts directly supported by and fixedly connected to a support device, said two parts having side walls which follow each other and define a recess for receiving the squeegee, said side walls of said two parts have provided therein grooves for holding a squeegee support element.

2. A squeegee arrangement according to claim 1, wherein a clamping device is arranged between the two parts and within a central region of said parts.

3. A squeegee arrangement according to claim 2 wherein the clamping arrangement comprises a screw or bolt which co-acts with a screw threaded part in the one part which is located closer to a rotational point of said one part than a point of clamping co-action with the squeegee.

4. A squeegee arrangement according to claim 1, wherein at least three support positions are provided.

5. A squeegee arrangement according to claim 1, wherein the support element is a flat bar whose opposing edge surface co-act with respective recesses provided in each of the two parts.

6. A squeegee arrangement according to claim 5, wherein the flat bar has a projection located between the recesses and which faces towards the squeegee so as to support the squeegee.

7. A squeegee arrangement according to claim 1, wherein each of the two parts comprises an extruded lightmetal profile.

8. A squeegee arrangement according to claim 2, wherein at least three support positions are provided.

9. A squeegee arrangement according to claim 2, wherein the support element is a flat bar whose opposing edge surfaces co-act with respective recesses provided in each of the two parts.

10. A squeegee arrangement according to claim 9, wherein the flat bar has a projection located between the recesses and which faces towards the squeegee so as to support the squeegee.

11. A squeegee arrangement according to claim 2, wherein each of the two parts comprises an extruded lightmetal profile.

12. A squeegee arrangement according to claim 3, wherein at least three support positions are provided.

13. A squeegee arrangement according to claim 3, wherein the support element is a flat bar whose opposing edge surfaces co-act with respective recesses provided in each of the two parts.

14. A squeegee arrangement according to claim 13, wherein the flat bar has a projection located between the recesses and which faces towards the squeegee so as to support the squeegee.

15. A squeegee arrangement according to claim 3, wherein each of the two parts comprises an extruded lightmetal profile.

16. A squeegee arrangement according to claim 4, wherein the support element is a flat bar whose opposing edge surfaces co-act with respective recesses provided in each of the two parts.

17. A squeegee arrangement according to claim 16, wherein the flat bar has a projection located between the recesses and which faces towards the squeegee so as to support the squeegee.

18. A squeegee arrangement according to claim 4, wherein each of the two parts comprises an extruded lightmetal profile.

* * * * *